United States Patent [19]

Heiling et al.

[11] 4,184,063

[45] Jan. 15, 1980

[54] THERMAL PRINTER WRITE HEAD ASSEMBLY

[75] Inventors: Gerald M. Heiling, Pine Island; LaVerne F. Knappe, Rochester; John L. Regehr, Stewartville, all of Minn.

[73] Assignee: International Business Machines Corporation, Armonk, N.Y.

[21] Appl. No.: 973,213

[22] Filed: Dec. 26, 1978

[51] Int. Cl.[2] ..... H05B 1/00

[52] U.S. Cl. ..... 219/216; 219/388

[58] Field of Search ..... 219/216, 388; 355/3 FU; 346/76 PH; 340/713, 756; 400/120; 178/30; 432/59, 227

[56] References Cited

U.S. PATENT DOCUMENTS

| | | | |
|---|---|---|---|
| 3,787,886 | 1/1974 | McCrady | 219/216 X |
| 3,845,850 | 11/1974 | Herf et al. | 219/216 X |
| 3,967,092 | 6/1976 | Conta et al. | 219/216 |
| 4,000,393 | 12/1976 | Cochran et al. | 219/216 |
| 4,039,065 | 8/1977 | Seki et al. | 346/76 R X |

*Primary Examiner*—C. L. Albritton

*Attorney, Agent, or Firm*—Robert W. Lahtinen

[57] ABSTRACT

A non-impact thermal printer is formed using a pivoted stiffner-frame on which is mounted a printed circuit card-print head assembly. The card is slotted with the print heads mounted at the distal ends of the cantilevered portions to enable close compliance between print head read/write units and the print media through the torsional resilience of the circuit card cantilevered portions. Compact, simple structure is provided by having the printer control circuitry mounted on the same printed circuit card.

10 Claims, 8 Drawing Figures

THERMAL PRINTER WRITE HEAD ASSEMBLY

DESCRIPTION

BACKGROUND OF THE INVENTION

This invention relates to thermal printers and more particularly to an improved thermal printer print head and electronic circuit assembly.

In prior art thermal printers significant attention has been paid to thermal print head design, but scant consideration has been given the overall design of the printer electronic packaging. Partitioning of the electronics and head structures is rendered necessary where the thermal print head is moved during on the fly printing, but when the print head structure is maintained stationary except for compliance between thermal print elements and the thermally sensitive printing paper, there is an opportunity to more closely integrate the electronic components into a single simplified package. To realize the optimum advantages of such a combination of the electronics is advantageous since it is usually an object of thermal printing applications to achieve an economical non-impact type printer.

SUMMARY OF THE INVENTION

The printer of the present invention combines the write head which prints a continuous line of thermal dots across the width of the paper print media with the printer control circuitry in a single assembly. The write heads are mounted on a printed circuit card that provides the resiliency to achieve close conformity with the media in cooperation with a biasing force imparted by the frame assembly on which the printed circuit card is mounted. The printed circuit card is slotted to provide upwardly extending cantilevered portions projecting from the balance or body portion of the card. The write heads are mounted on the cantilevered portions adjacent the distal ends thereby allowing the cantilevered portions to be biased slightly away from the plane of the body portion and to allow some torsional flexing to achieve the desired close proximity to the print media in cooperation with a roller platen over which the media is trained. The frame or stiffner to which the printed circuit card and body portion is positively secured also carries the biasing elements which urge the write heads toward a printing engagement with the media when the assembly is retained in a detented operating position.

The structure can also be carried a step further by mounting another circuit card on the stiffner frame at the surface opposite that confronting the media and platen. This circuit card could carry the interface logic circuits necessary to connect the printer to a specific device. This will still afford a separation of the electrical circuits associated with the printing function and the circuitry that is needed to interface the printer with the data and control of the host device. This arrangement would be particularly convenient where the host implements the power supply function whereby the entire print function would be provided by the print head assembly, platen assembly and paper supply structure.

DETAILED DESCRIPTION

Figure 1:
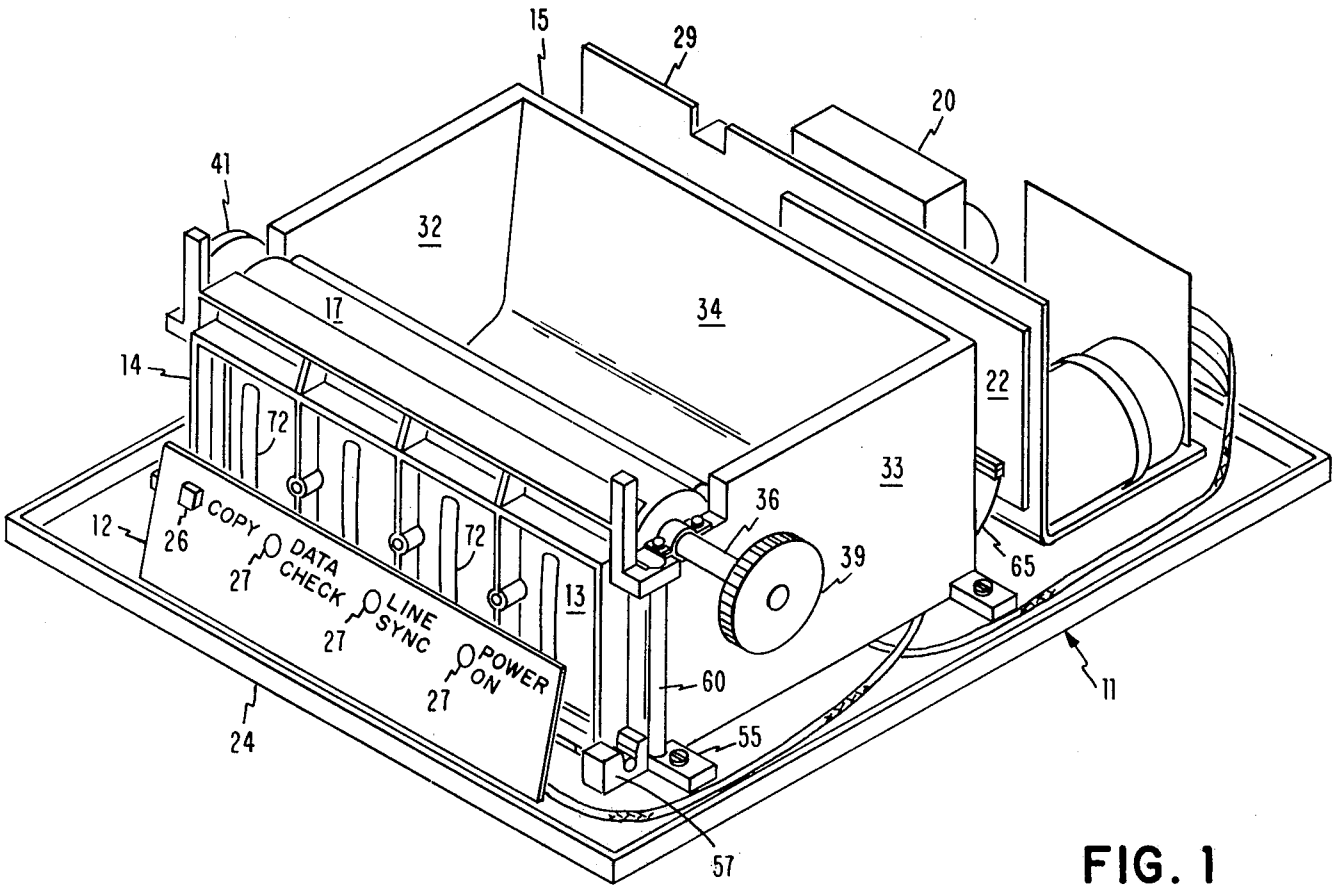
FIG. 1 is an isometric view of the thermal printer assembly used in the present invention showing the frame and subassemblies mounted thereon and with the cover removed.

The printer 11 includes a control panel 12, a print head card 13 mounted on a stiffener or frame 14, a paper cradle 15 that carries a platen 17 and a driving motor 19 (FIG. 2), and a power supply 20 on which is mounted an interface logic card 22. Each of these assemblies is mounted on and carried by a frame 24.

The control panel 12 carries the operating switches and indicator signals. Exemplary of such would be a copy switch 26 to initiate a print cycle and indicator lights 27 indicative of operating conditions such as a data check, line sync or power on.

At the rear of the printer assembly is a power supply 20 mounted on a formed metal plate 29 that provides both electrical shielding and a subframe for the power supply assembly. Secured to the plate 29 by stand off clips (not shown) is a printed circuit card 22 that carries the interface logic circuitry for printer 11.

Figure 2:
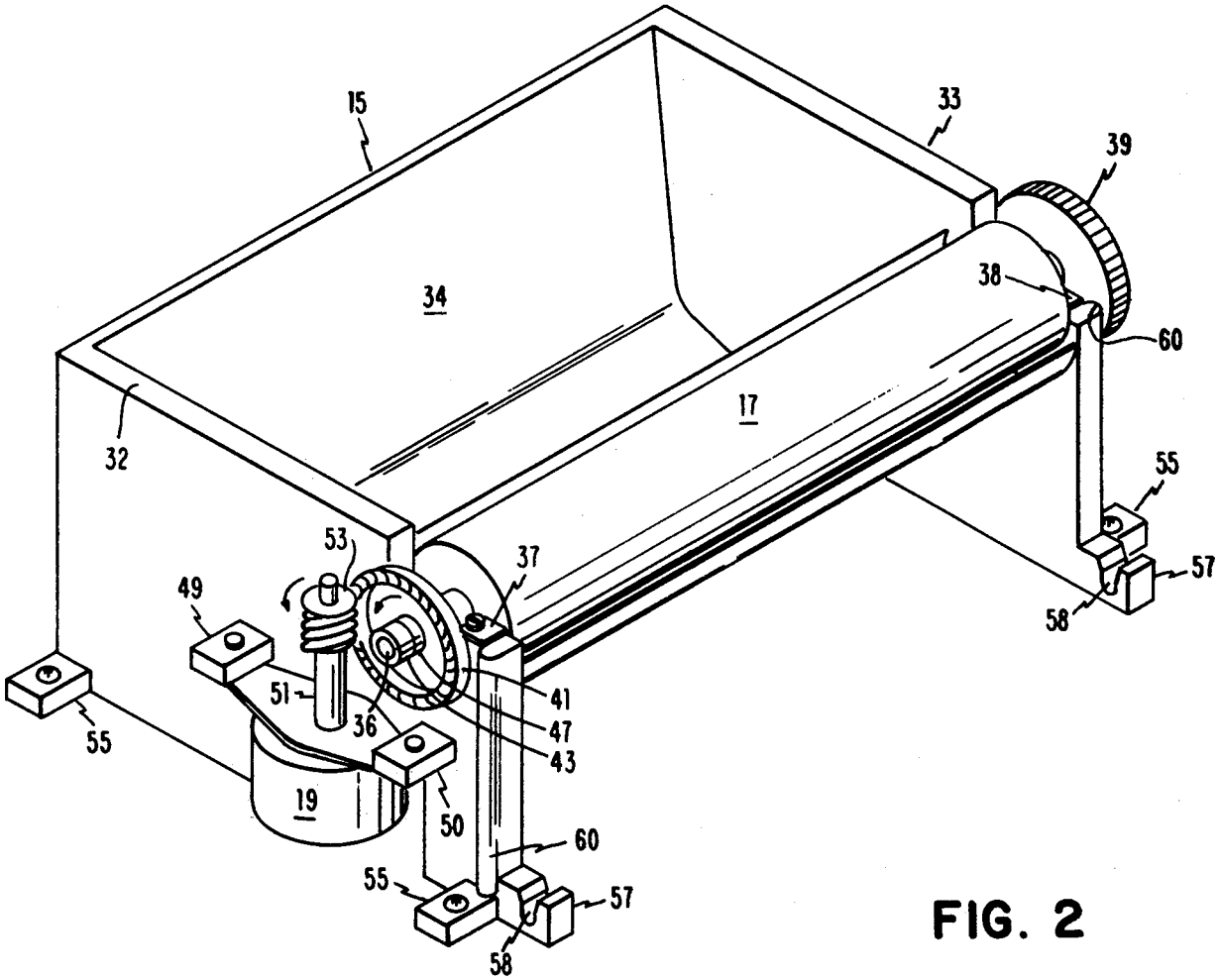
FIG. 2 is an isometric view of the platen, drive motor and paper cradle subassembly of FIG. 1.
Figure 3:
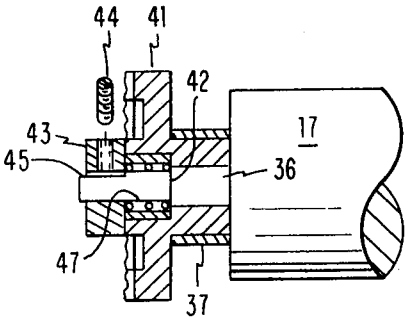
FIG. 3 is a section view through the axis of the helicon platen drive gear of FIG. 2 also including the overrunning clutch for one way drive of the platen shaft.

As shown in FIG. 2, the paper cradle 15 has side walls 32, 33 interconnected by a curved wall 34 which forms a recess for receiving and confining a roll of paper. A platen 17 has a shaft 36 extending from each axial end and is mounted on side walls 32, 33 by bearings 37, 38 respectively which receive such shaft 36. A thumb wheel 39 is secured to one end of shaft 36 for movement in unison therewith to provide for manual advance of the paper. Adjacent the opposite end of shaft 36 is mounted a helicon face gear 41 which is retained between the shoulder 42 where shaft 36 is reduced in diameter and the collar 43 which includes a set screw 44 (FIG. 3) that engages a flatted surface 45 on the shaft 36 in the assemblied condition. An overrunning clutch 47 is pressed into the central bore of gear 41 and cooperates with shaft 36 to permit the shaft to rotate in a counter clockwise direction as viewed in FIG. 2 while preventing clockwise rotation. The platen 17 can thus be rotated to advance the paper media through manipulation of thumb wheel 39 independently of the movement of gear 41.

Figure 4:
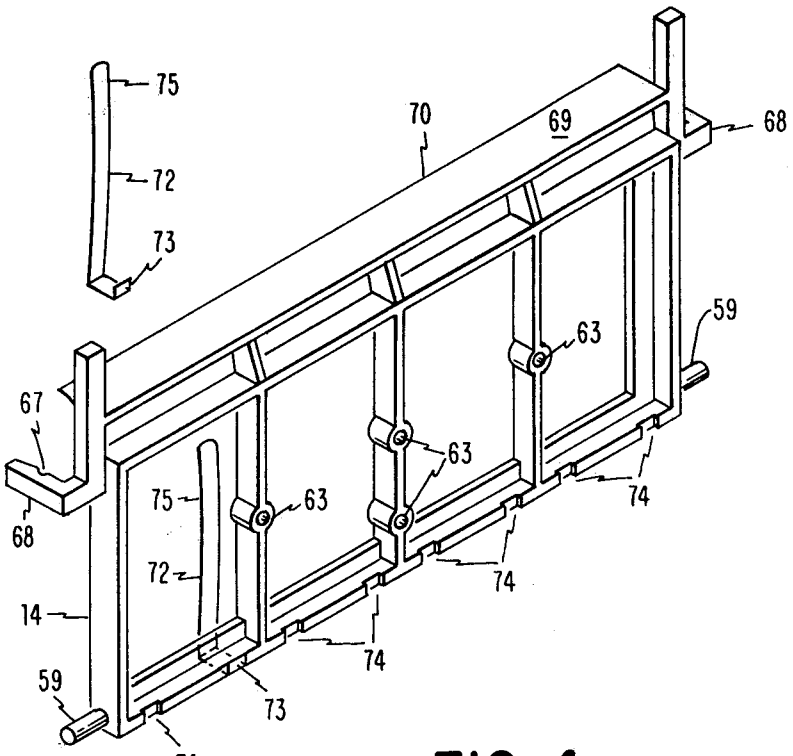
FIG. 4 is an isometric view of the stiffner for mounting the print head card.

Mounted on ears 49, 50 extending from side wall 32 and formed as an integral part thereof is a synchronous motor 19. The output shaft 51 of motor 19 carries a helicon pinion or worm gear 53 that engages face gear 41 to impart rotatory motion to platen 17. Paper cradle 15 also has formed as an integral part thereof four apertured projections 55 which provide for mounting the paper cradle platen assembly on the printer frame 24. Projections 57 have upwardly facing U shaped openings 58 for receiving trunions 59 of the print head card stiffener 14 (FIG. 4). Also formed as integral parts of the side walls 32, 33 are detent ridges 60.

Figure 5:
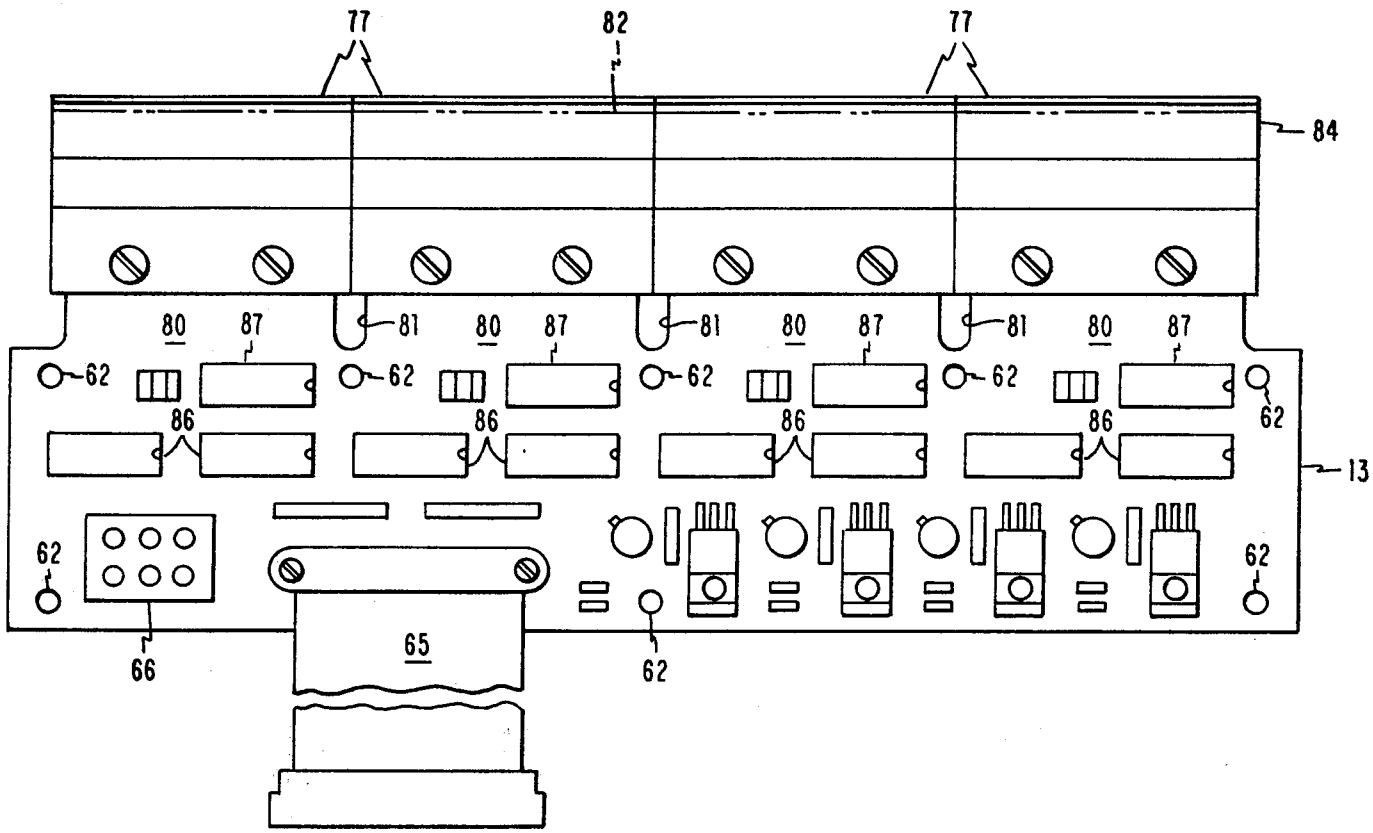
FIG. 5 is an elevation of the print head card.

FIG. 4 shows the print head card stiffener 14 which is molded as a single part. The print head card 13 (FIG. 5) shows the side which confronts the platen and is mounted on the stiffener at the rear of the side in FIG. 4. Print head card 13 is secured to stiffener 14 by either clips or screws (not illustrated) that extend through card apertures 62 and are received in stiffener bores 63 (some of which are visible). Print head card 13 is electrically connected to logic card 22 by a flat cable 65 and to the power supply 20 by cabling which is attached to voltage connector 66. The stiffener further includes trunions 59 which are received in paper cradle openings 58 and detent recesses 67 in arms 68 which engage the detent ridges 60. The trunions 59 and detents 67 function to retain the print head card 13 mounted on stiffener 14 in an operating position confronting platen 17. Stiffener 14 also includes an upper portion 69 of wedge shaped cross section that presents a tear edge 70 for severing a projecting length of paper from the supply roll. Mounted on stiffener 14 are a series of eight spring elements 72 which have turned lower ends 73 that are received in and positioned by stiffener slots 74 and have upper ends 75 which engage the print head card 13 at the rear of the print heads 77 to urge the print heads toward platen 17 when in the assemblied operating condition to assure conforming contact with the thermal print paper 78 trained over platen 17. Print head card 13 terminates upwardly in 4 cantilevered portions separated by slots 81. Each cantilevered portion 80 carries one of the print heads 77.

Print head card 13 contains the print circuitry to actuate and control the thermal print head 77. Voltage connector 66 interconnects the printer circuits with the power supply 20. The lines of the flat cable 65 interconnect the printer circuits on the print head card 13 with the interface logic on card 22 for receipt of control and data signals. The four print heads 77 present a continuous line of thermal print dots 82 which aggregate in total the number of thermal dot positions forming one line of a dot matrix print line. Each print head comprises a metalized ceramic substrate 84, the land patterns of which are connected to the conductive land patterns of the printed circuit board forming the print head card 13. Print head card 13 carries a series of large scale integration (LSI) modules 86 which contain the print head drivers and other LSI modules 87 which contain address counters.

Figure 6:
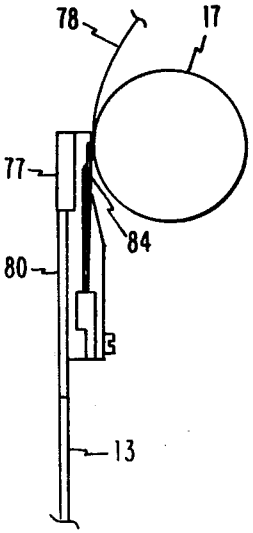
FIG. 6 is a side elevation of the print head card print head assembly showing its cooperation with the platen and thermal print media.

As seen in FIG. 6 the print head card 13 and the thermal print heads 77 are biased toward platen 17 in the operating condition. The print head card assembly is biased toward tangency with the platen along the line of the thermal print dots 82 to hold the paper media captive therebetween causing the thermal print heads 77 to be the pressure pad that assures that the paper moves in unison with the platen surface while concurrently assuring closely conforming thermal printing contact between the print dots 82 and the thermal paper media 78.

Figure 8:
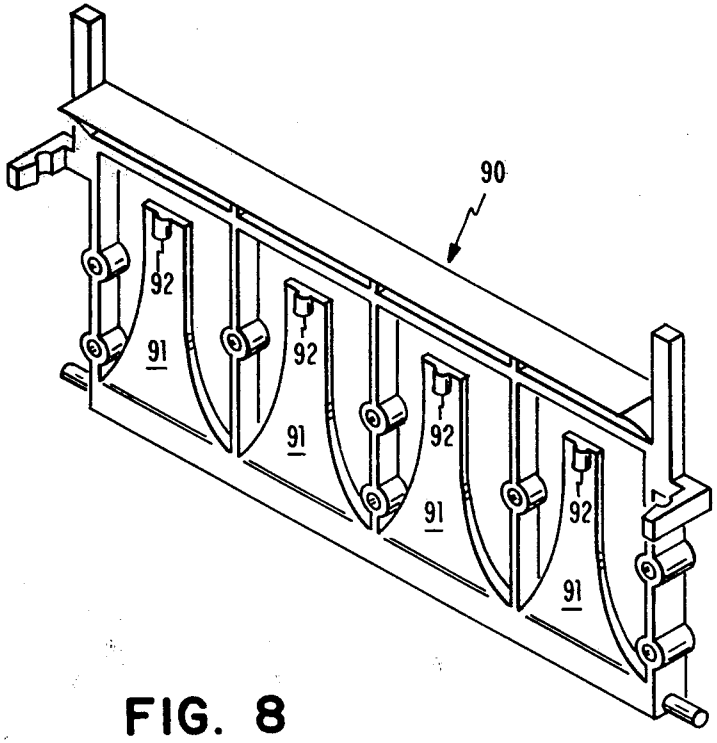
FIG. 8 is an alternative embodiment for the stiffner of FIG. 4 showing the biasing structure molded as an integral part display and associated printer circuitry.

FIG. 8 shows a modified print head card stiffener 90 wherein the print head biasing elements 91 are molded as an integral part of the stiffener. Each of the elements 91 inclines slightly outward from the print head card mounting plane and includes at the distal end a semicylindrical projection 92 that engages the confronting thermal print head centrally at its rear surface and rockably biases the print head toward close conformity with the platen surface and thermally sensitive paper 78. Each of the thermal print heads 77 is mounted on a cantilevered projection 80 separated from the adjoining projection by a slot 81. The cantilevered projections 80 afford sufficient flexibility to enable torsional adjustment induced by the biasing elements 91 to achieve the necessary adjustment.

The mode of operation of the printer in printing a sequence of lines of thermal print dots enables the device to print out the content of a CRT screen display by printing a sequence of lines on the thermal print medium 78 which reproduces the sequence of raster lines of dots on the CRT screen. This is accomplished by the printer shown and described herein by printing one raster line of data during each refresh cycle of the CRT. The use of successive refresh cycles also makes it immaterial whether the CRT refreshes successive lines or uses an interlaced raster. The printer logic circuits are also simplified in this approach to a CRT screen print application since the serial data supplied to the CRT is used concurrently by the printer eliminating the need for duplicate character generators and associated circuitry.

Figure 7:
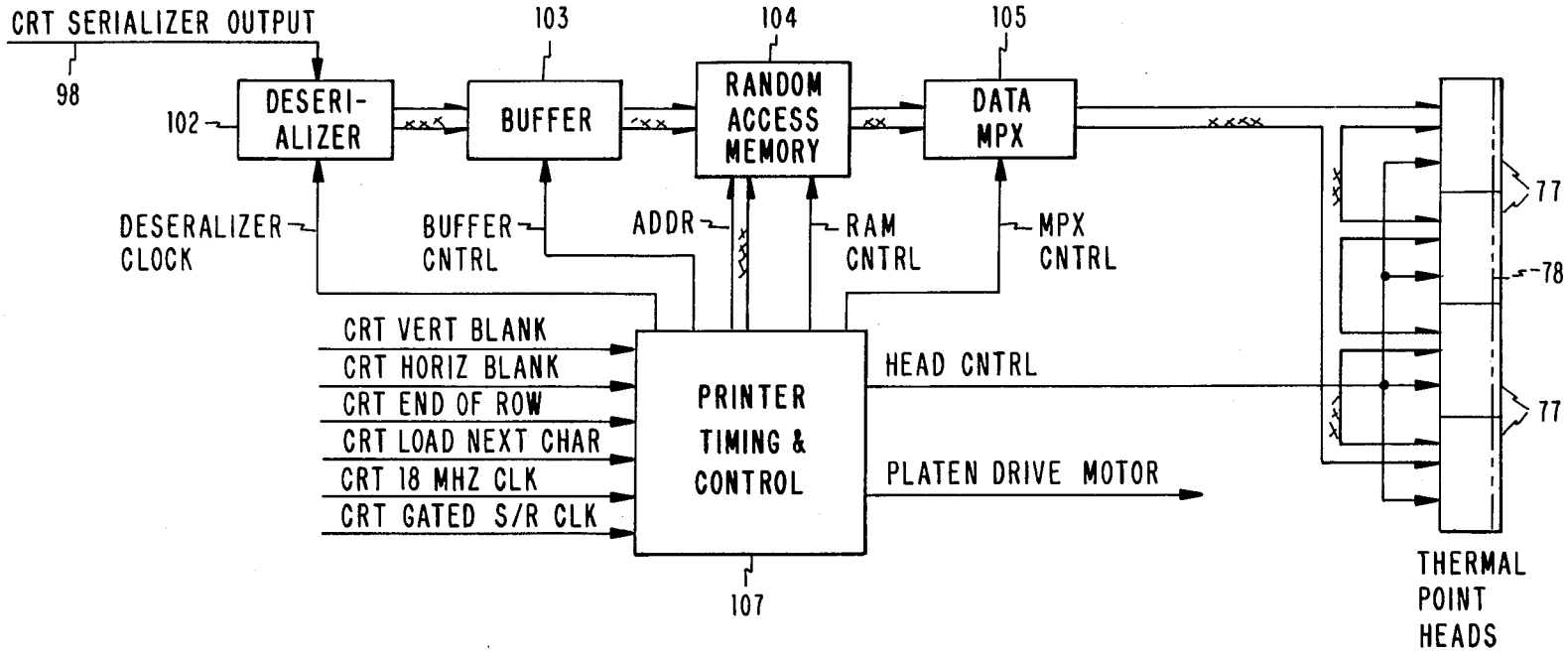
FIG. 7 is a schematic circuit diagram showing the printer interface logic for handling data from an associated display.

FIG. 7 illustrates logic circuitry for adapting the printer for the output printing of the content of a raster scan CRT display. The serial data on line 98 transmitted to the CRT is also connected to a deserializer shift resister 102. The serial data to the CRT is continuously received also by the shift register 102 but is gated to buffer 103 only when a print operation is occurring and the data associated with the line to be printed is being received by shift register 102. The serial data is transferred from register 102 to buffer 103 and from there is stored in the random access memory (RAM) 104 until the 800 bits for one line of thermal dot printing have been received. The line of data is transmitted to the print head 77 by the multiplexer circuits 105. The multiplexer 105 selectively gates the data to the thermal print dot drivers in accordance with the needs of the system. Although the thermal print dots 82 constitute one continuous row of dots transverse to the direction of motion of the paper media or one raster scan of the CRT screen, various blocks of print dots are often staggered in the direction of paper travel to enable non simultaneous actuation. This is accommodated by the multiplexer to cause all dots in one line of data to appear on a single straight line on the print media.

Various control signals are also received by the printer timing and control circuitry 107 from the CRT display control logic to enable the printer to coordinate the printing of the data on the CRT. In addition to receiving, selecting, storing and multiplexing the print data, the printer control logic also controls the start and stop of the platen drive motor 19. The motor speed is coordinated to the print operation to cause the paper to advance a distance between the lines of printed dots approximately equal to the distance between adjacent dots within a line of dots. Thereby the aspect ratio is maintained between characters or other information displayed on the CRT screen and printed on the thermal print medium to give a faithful reproduction.

A further modification of the design of the printer illustrated and described would be the mounting of another printed circuit board on the stiffener-frame 14 at the side opposite that occupied by print head card 13. This second printed circuit card secured to the stiffener-frame 14 would replace logic card 22 to place all the electronic control for both the print function and the interface to the using device on the single assembly. This would simplify the printer structure particularly in a device where the host system provided the power supply function. The printer then would require only the electronic assembly on the stiffener-frame 14, the control panel and the platen-paper supply assembly.

While the preferred embodiments of the invention have been illustrated and described in the foregoing, it is to be understood that it is not intended that the invention be limited to the precise constructions herein disclosed and the right is reserved to all changes and modifications coming within the scope of the invention as defined in the appended claims.

Having described our invention, what we claim as new and desire to secure by Letters Patent is:

1. A thermal printer comprising a platen element;

means for advancing a recording medium in unison with the surface of said platen element; and a thermal print head mounting assembly including:

a resilient planar supporting member, slot means extending partially across said member to form a plurality of cantilevered portions extending from the body of said supporting member, thermal print elements respectively substantially aligned along one side of each of said cantilevered portions adjacent to the distal ends thereof, a stiffener-frame secured to the body of said supporting member, and biasing means carried by said stiffener-frame and engaging the side of each of said cantilevered portions opposite said one side for biasing said thermal print elements toward said platen with said recording medium therebetween, whereby said cantilevered portions are individually resiliently moveable to closely conform to the surface of said recording medium to maintain continuous contact between said substantially aligned row of thermal print elements and said recording medium.

2. The thermal printer of claim 1 wherein said resilient planar supporting member comprises a printed circuit card and said body portion has mounted thereon electronic circuitry for controlling the activation of said thermal print elements.

3. The thermal printer of claim 2 wherein said thermal print elements are carried by a plurality of print heads each respectively mounted on one of said plurality of cantilevered portions and so aligned with one another to enable such print elements to produce a continuous aligned row of printed dots on said recording medium trained over said platen.

4. The thermal printer of claim 3 wherein said biasing means is formed as an integral part of said stiffner-frame.

5. The thermal printer of claim 3 wherein said biasing means comprises a plurality of leaf spring elements carried by said stiffener-frame and engaging said printed circuit card cantilevered portions to bias said cantilevered portions in a direction away from said stiffner-frame.

6. The thermal printer of claim 3 further comprising a frame member and pivotable mounting means for pivotably securing said stiffener-frame to said frame member about an axis parallel to the axis of said platen.

7. The thermal printer of claim 3 wherein said means for advancing a recording medium comprises a synchronous motor connected to said platen to drive said platen at a constant, rotational speed during print operations.

8. A thermal printer comprising a rotary platen element;

means for rotating said platen element and advancing a recording medium trained partially about said platen element in unison therewith; and a thermal print head mounting assembly including a stiffener-frame mounted adjacent said platen element;

a relilient planar printed circuit board with slot means extending from one side to form a plurality of cantilevered portions extending from a body portion;

securing means attaching said body portion to said stiffener-frame along the side thereof confronting said platen element;

thermal print heads with thermal print elements thereon respectively mounted on said cantilevered portions to present said thermal print elements in confronting relation with respect to said platen element and a recording medium trained thereover;

electric circuit means for controlling the activation of said thermal print elements mounted on said printed circuit card body portion; and biasing means carried by said stiffner frame and engaging said cantilevered portions to bias said print heads toward said platen element.

9. The thermal printer of claim 8 wherein said biasing means is formed as an integral part of said stiffener-frame.

10. The thermal printer of claim 8 wherein said biasing means comprises a plurality of spring elements carried by said stiffner frame and, engaging said cantilevered portions to urge said cantilevered portions away from said stiffener-frame.

* * * * *